US006918227B2

(12) United States Patent
Salicini et al.

(10) Patent No.: US 6,918,227 B2
(45) Date of Patent: Jul. 19, 2005

(54) METHOD AND DEVICE FOR END CLOSING TUBULAR WRAPPINGS OF PRODUCTS

(75) Inventors: Sandro Salicini, Monterenzio (IT); Stefano Cavallari, Bologna (IT)

(73) Assignee: Azionaria Costruzioni macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/420,960

(22) Filed: Apr. 22, 2003

(65) Prior Publication Data

US 2003/0226335 A1 Dec. 11, 2003

(30) Foreign Application Priority Data

Apr. 23, 2002 (IT) ..... BO2002A0223

(51) Int. Cl.[7] ..... B65B 7/06

(52) U.S. Cl. ..... 53/373.6; 493/308; 493/311; 493/453; 493/309; 53/371.9; 53/373.7; 53/371.7; 53/372.2; 53/374.9; 53/375.2

(58) Field of Search ..... 493/308, 309, 493/311, 453; 53/371.7, 371.9, 372.2, 374.9, 375.2, 377.6, 384.1, 492, 373.7, 375.9, 373.6

(56) References Cited

U.S. PATENT DOCUMENTS

| | | | | | |
|---|---|---|---|---|---|
| 2,114,624 | A | * | 4/1938 | Bergstein | 53/373.6 |
| 2,168,241 | A | * | 8/1939 | Robinson | 53/373.6 |
| 2,349,732 | A | * | 5/1944 | Howard | 53/411 |
| 2,415,978 | A | * | 2/1947 | Vergobbi | 53/373.6 |
| 2,606,856 | A | * | 8/1952 | Hurrey et al. | 156/273.3 |
| 2,626,495 | A | | 1/1953 | Gaubert | |
| 2,902,805 | A | | 9/1959 | Petrea | |
| 3,143,232 | A | * | 8/1964 | Hansel, Jr. et al. | 414/416.06 |
| 3,241,290 | A | * | 3/1966 | Ingleson et al. | 53/373.6 |
| 4,070,853 | A | * | 1/1978 | Sanders | 53/370.6 |
| 4,221,101 | A | * | 9/1980 | Woods | 53/79 |
| 4,546,592 | A | * | 10/1985 | Reil | 53/373.6 |
| 5,642,599 | A | * | 7/1997 | Tisma | 53/373.6 |
| 6,662,532 | B1 | * | 12/2003 | Droog et al. | 53/459 |

FOREIGN PATENT DOCUMENTS

| | | |
|---|---|---|
| GB | 1 262 279 A | 2/1972 |
| GB | 1 582 777 A | 1/1981 |
| GB | 2 217 288 A | 10/1989 |

* cited by examiner

*Primary Examiner*—Louis K. Huynh
*Assistant Examiner*—Hemant M Desai
(74) *Attorney, Agent, or Firm*—Ladas and Parry LLP

(57) ABSTRACT

A method and device for end closing tubular wrappings of products, whereby the arms of a scissor-type parting device, once inserted in a closed position inside an end portion of a tubular wrapping, are allowed to part, and are pushed by springs into a fully open position throughout an extraction stroke to crease the end portion and enable the end portion to be pressed taut and accurately by the opposing thrust of two folding-sealing members.

10 Claims, 3 Drawing Sheets

METHOD AND DEVICE FOR END CLOSING TUBULAR WRAPPINGS OF PRODUCTS

The present invention relates to a method of end closing tubular wrappings of products.

More specifically, the present invention relates to a method of end closing tubular wrappings of products, of the type comprising the steps of imparting an insertion stroke to a scissor-type parting device to insert the parting device axially inside an end portion of the tubular wrapping projecting from a corresponding end of the relative product, the parting device comprising two arms movable with respect to each other between a closed rest position and an open stretch position, and commencing said insertion stroke in the closed position; moving said arms into the open position to deform said end portion into a duckbill shape and define, on the deformed end portion, two facing, substantially flat walls; imparting an extraction stroke to said parting device to withdraw the parting device from said end portion; and gripping said end portion between two folding-sealing members to seal said walls to each other.

The present invention is particularly advantageous for wrapping stacks of sweets and similar, to which the following description refers purely by way of example.

BACKGROUND OF THE INVENTION

On wrapping machines, particularly for wrapping stacks of sweets and similar, in which the ends of tubular wrappings are closed using the known method described above, the scissor-type parting device is opened by means of a cam device, which moves the movable arms into the open position at a given point along the insertion stroke inside the relative end portion of the tubular wrapping for closing, and closes the movable arms at a corresponding point along the extraction stroke (the opening and closing movements, being governed as they are by the same cam device, necessarily being specular).

The above known method involves several drawbacks, mainly on account of the above movements imparted to the arms of the parting device.

In the first place, the parting device necessarily opens, during the insertion stroke, before reaching the end of the end portion to be deformed (otherwise, since the opening and closing movements are specular, the parting device would close at the same point at which it is opened, without effecting any deformation), and then proceeds in the open position until it contacts the relative end of the product, thus resulting in "crumpling" of the end portion.

In the second place, the parting device closes before it is fully withdrawn from the end portion being deformed, thus failing to ensure the opposite flaps of the end portion are properly taut when gripped between the folding-sealing members.

And finally, since the parting device closes before being fully withdrawn from the end portion, correct duckbill shaping of the outer portion of the end portion is not necessarily guaranteed.

SUMMARY OF THE INVENTION

It is an object of the present invention to provide a method of end closing tubular wrappings, designed to eliminate the aforementioned drawbacks.

According to the present invention, there is provided a method of end closing tubular wrappings, as claimed in Claim 1 and, preferably, in any one of the Claims depending directly and/or indirectly on Claim 1.

The present invention also relates to a device for, end closing tubular wrappings.

According to the present invention, there is provided a device for end closing tubular wrappings, as claimed in Claim 6 and, preferably, in any one of the Claims depending directly and/or indirectly on Claim 6.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
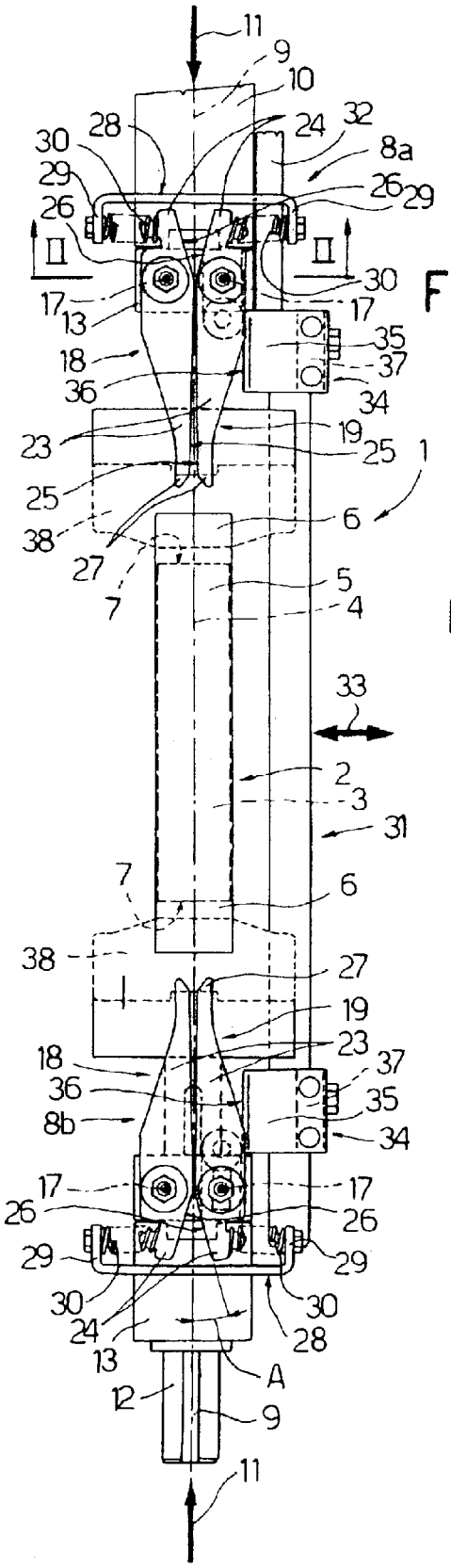
FIG. 1 shows a schematic plan view, with parts removed for clarity, of a preferred embodiment of the closing device according to the present invention.

Number 1 in FIG. 1 indicates as a whole a device for end closing a tubular wrapping 2 enclosing an elongated product 3 defined, in the example shown, by a stack of sweets or similar, and having a longitudinal axis 4. In the example shown, tubular wrapping 2 and product 3 are substantially cylindrical, but may be of any other elongated shape. Tubular wrapping 2 is formed in known manner from a sheet of heat-seal wrapping material, and comprises a central portion 5 contacting product 3; and two end portions 6, each of which projects outwards with respect to a relative end surface 7 of product 3, and must be closed to end close tubular wrapping 2.

Figure 2:
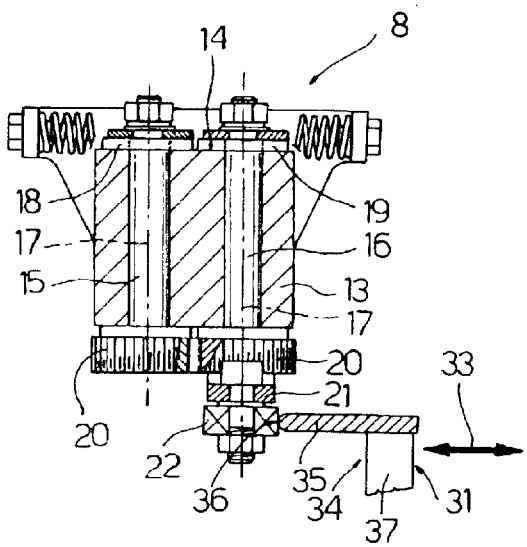
FIG. 2 shows a section along line II—II in FIG. 1.

With reference to FIGS. 1 and 2, closing device 1 comprises two parting devices 8 located an adjustable distance apart, and facing each other along an axis 9, which, in use, coincides with longitudinal axis 4 of product 3. In the example shown, one of the two parting devices 8, located at the top in FIG. 1 and indicated 8*a*, is fitted to an actuating rod 10 parallel to axis 9, and which performs a forward or insertion stroke and a return or extraction stroke in a direction 11; and the other parting device 8, indicated 8*b*, is fitted, so as to be adjustable axially as a function of the length of tubular wrapping 2, to an actuating rod 12 substantially coaxial with actuating rod 10 and movable in the opposite sense to actuating rod 10 to also perform a forward or insertion stroke and a return or extraction stroke in direction 11.

Each parting device 8 is a scissor-type parting device comprising a supporting block 13, which is connected to the relative actuating rod 10, 12, is defined at the top by a flat surface 14, and is fitted through with two pins 15 and 16, which have respective parallel axes 17, are located side by side in a plane perpendicular to axis 9, and are perpendicular to surface 14. Pins 15 and 16 are fitted in rotary manner to relative block 13, and are fitted, on top and substantially contacting surface 14, with respective flat rocker arms 18 and 19, preferably made of sheet metal and coplanar with each other. Underneath relative block 13, pins 15 and 16 are fitted with respective gears 20 meshing with each other and having a 1:1 gear ratio; and pin 16 is fitted, underneath relative gear 20, with a crank 21 perpendicular to relative axis 17 and fitted on the free end with a tappet roller 22.

With reference to FIG. 1, each rocker arm 18, 19 comprises an inner arm 23, i.e. facing the other parting device 8, and an outer arm 24 located on opposite sides of relative axis 17. More specifically, viewed from above, each inner arm 23 tapers towards its free end, and is defined, on the side facing the other rocker arm 19, 18, by a straight edge 25, which is positioned parallel to axis 9 and substantially contacting edge 25 of inner arm 23 of the other rocker arm 19, 18, when relative parting device 8 is in the closed rest position; and, viewed from above, each outer arm 24 also tapers towards its free end, and is defined, on the side facing the other rocker arm 19, 18, by a straight edge 26, which is positioned parallel to axis 9 and substantially contacting edge 26 of outer arm 24 of the other rocker arm 19, 18, when relative parting device 8 is in the fully open position. In other words, the angle by which each rocker arm 18, 19 rotates about relative axis 17 to pass from the closed to the fully open position equals an angle A between relative edge 26 and an extension of relative edge 25 towards relative edge 26, and the size of which is so selected that, when relative parting device 8 is in the fully open position, the distance between the outer edges of free-end portions 27 of the two inner arms 23 equals at least "R", where R is the radius of tubular wrapping 2 or, if tubular wrapping 2 is not cylindrical, the radius of the cylinder in which tubular wrapping 2 can be inscribed.

Outwards of relative rocker arms 18 and 19, each parting device 8 comprises a U-shaped bracket 28 fitted to relative block 13, with its concavity facing outer arms 24, and with two opposite wings 29 located alongside and on opposite sides of arms 24 to support respective springs 30, each of which is positioned substantially crosswise to axis 9 and compressed between relative wing 29 and the outer edge of relative outer arm 24 to keep relative rocker arm 18, 19 normally in the fully open position.

Beneath and alongside blocks 13, there is provided a locking device 31 for locking inner arms 23 of the two parting devices 8 in the closed position. Locking device 31 comprises an actuating rod 32 parallel to axis 9 and rotating about its axis to move locking device 31, in a direction 33 substantially crosswise to axis 9, between a lock position contacting parting devices 8, and a rest position detached from parting devices 8.

Locking device 31 also comprises two cam members 34, each of which is L-shaped, is associated with a relative parting device 8 to cooperate with relative tappet roller 22, and in turn comprises a top plate 35 substantially parallel to top surface 14 of relative supporting block 13, and having a lateral edge 36 cooperating with relative tappet roller 22, and a bottom arm 37 extending upwards with respect to the axis of rod 32, and rotating with rod 32 to move relative plate 35 between said lock and rest positions. More specifically, the length of edge 36 is such that, if relative plate 35 were kept permanently in the lock position, inner arms 23 of rocker arms 18 and 19 of relative parting device 8 would be kept permanently in the closed position, regardless of the position assumed by parting device 8 as it moves in direction 11 with respect to tubular wrapping 2.

For each parting device 8, closing device 1 also comprises two folding-sealing members 38, which are indicated 38*a* and 38*b* and located respectively above and below the plane defined by relative rocker arms 18 and 19. Folding-sealing members 38*a* and 38*b* are movable, in opposite senses in a direction 39 parallel to pins 15 and 16, to and from a closed position gripping a relative end portion 6 of tubular wrapping 2.

Figure 3:
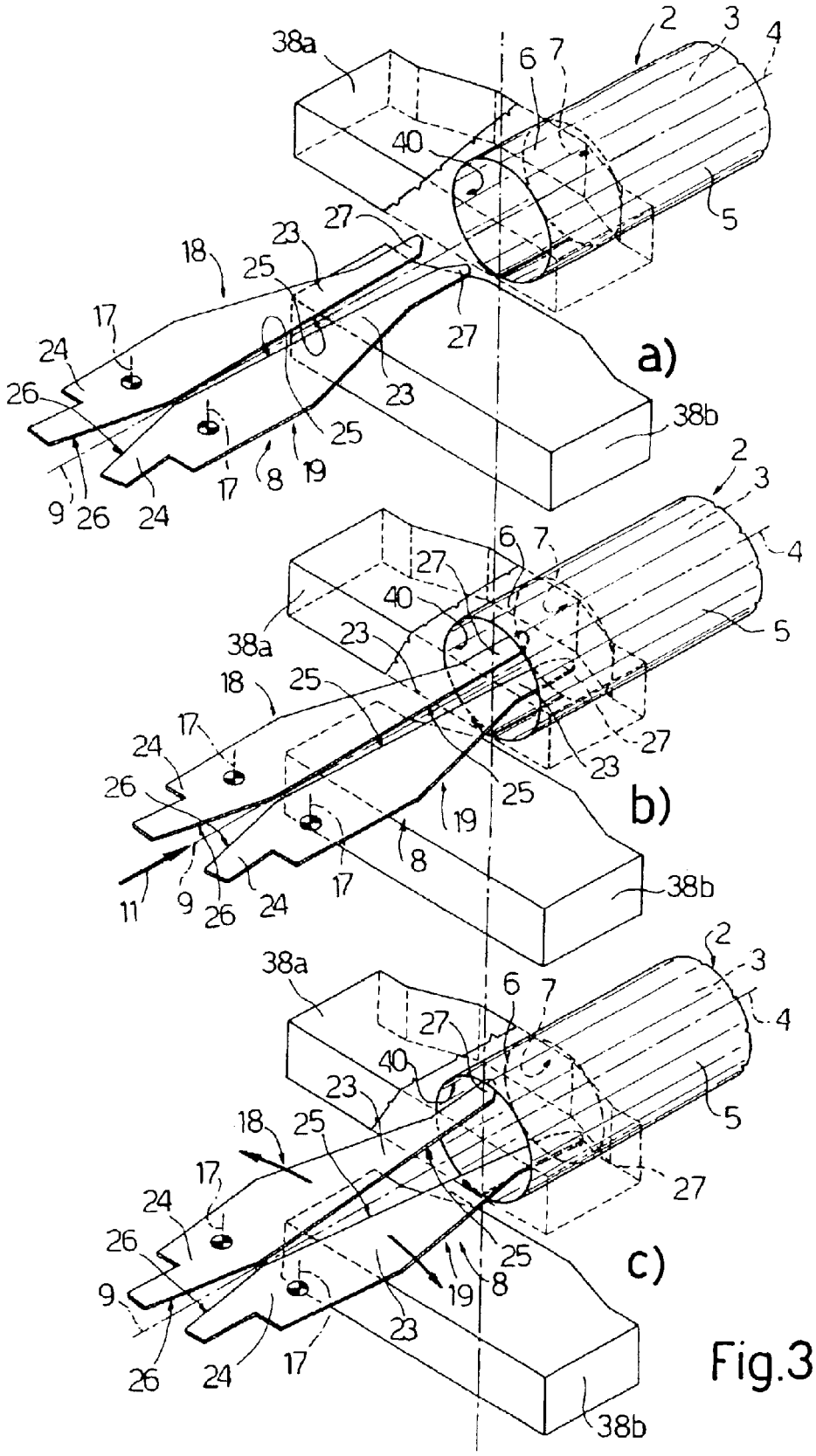
FIGS. 3 and 4 show respective operating sequences of a detail in FIG. 1.
Figure 4:
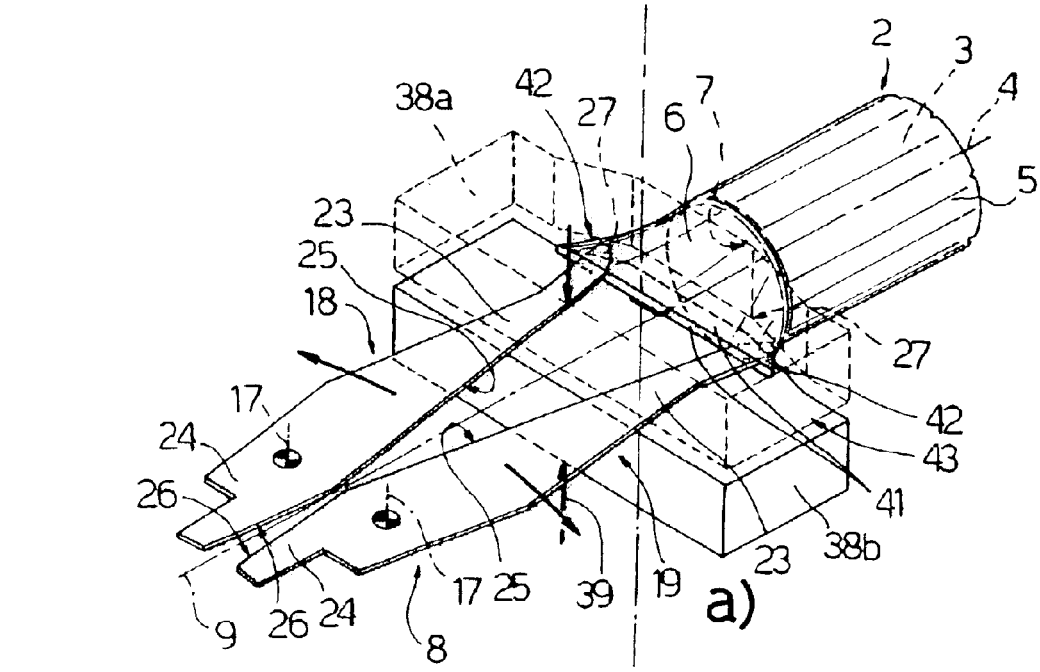
Figure 4:
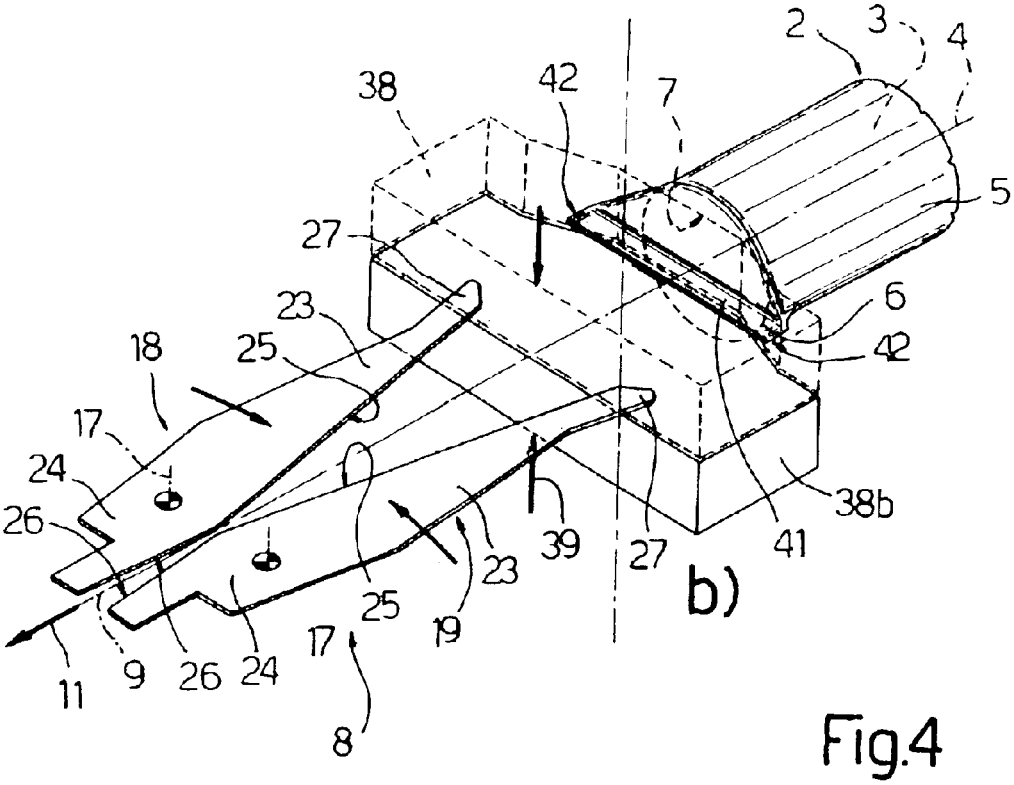

Operation of closing device 1 will now be described with reference, in particular, to FIGS. 3 and 4, and, given the identical, specular operation of parting devices 8*a* and 8*b*, with reference to only one parting device indicated 8.

When tubular wrapping 2, fed crosswise to its longitudinal axis 4 by a known conveying device (not shown), is arrested with its longitudinal axis 4 coaxial with axis 9 (FIG. 3*a*), parting device 8 is in a withdrawn rest position at the start end of its insertion stroke, with end portions 27 of inner arms 23 outside the facing end portion 6. In this position, locking device 31 is in the FIG. 1 lock position, and keeps the two inner arms 23 substantially contacting each other, i.e. in the closed position.

Parting device 8 then performs the insertion stroke in direction 11 to bring end portions 27 substantially into contact with end surface 7 of product 3 (FIG. 3*b*); and, throughout the insertion stroke, locking device 31 remains in the FIG. 1 lock position to keep inner arms 23 in the closed position. At this point, actuating rod 32 (FIG. 1) is rotated to withdraw plate 35 from relative tappet roller 22 in direction 33, so that inner arms 23 are rotated by springs 30 about relative axes 17 into the open position, and relative end portions 27 exert substantially constant pressure on an inner surface 40 of relative end portion 6.

Parting device 8 (FIG. 4*a*) then begins the extraction stroke, and gradually deforms end portion 6 into a duckbill shape. More specifically, during the extraction stroke, end portions 27 of inner arms 23 slide along inner surface 40 to form, on end portion 6, two diametrically opposite crease lines, so that at least the free end of end portion 6 gradually assumes the form of two substantially flat, parallel walls 41, which are connected along edges 42 extending along said crease lines, and are kept perfectly taut by inner arms 23 pushed constantly, throughout the extraction stroke, into the fully open position by springs 30. The folding of end portion 6 along edges 42 is assisted by folding-sealing members 38, which, maintained in an open position throughout the insertion stroke, are moved towards each other in direction 39 as soon as the extraction stroke starts, and are arrested in an intermediate position (FIG. 4*a*) defining, between them, a gap 43 wide enough to loosely accommodate the two walls 41 and inner arms 23.

When inner arms 23, still pushed by springs 30 into the fully open position, withdraw completely from end portion 6 (FIG. 4*b*), the two folding-sealing members 38 are pressed together in direction 39 to seal the two walls 41 and close the end of end portion 6. When parting device 8 completes the extraction stroke, locking device 31 is reactivated to restore inner arms 23 to the closed position.

In connection with the above, it should be stressed that: inner arms 23 are only allowed to open at the end of the insertion stroke; inner arms 23 are pushed constantly into the fully open position throughout the extraction stroke and, at any rate, until they withdraw completely from end portion 6; and said crease lines are formed to ensure that, when sealed, walls 41 are perfectly taut and perfectly connected to each other along edges 42.

What is claimed is:

1. A device for end closing tubular wrappings (2) of products (3), the device comprising:

a scissor-type parting device (8), in turn comprising two arms (23) movable with respect to each other between a closed rest position and an open stretch position;

first actuating means (10, 12) for imparting to said parting device (8) an insertion stroke and an opposite extraction stroke in a first given direction (11) with respect to an end portion (6) of the tubular wrapping (2) projecting from a corresponding end (7) of the relative product (3);

second actuating means (30) for moving said arms (23) from said closed position to said open position, to deform said end portion (6) into a duckbill shape and define, on the deformed end portion (6), two facing, substantially flat walls (41) and for enabling said arms (23) to exert substantially constant pressure on said end portion (6) of the tubular wrapping (2) throughout the extraction stroke;

two folding-sealing members (38) movable in opposite senses in a second direction (39) crosswise to said first direction (11) to seal said walls (41) to each other; and locking means (31) for keeping said arms (23) in the closed rest position during the insertion stroke;

wherein said second actuating means (30) are elastic actuating means.

2. A device as claimed in claim 1, wherein each said arm (23) forms part of a respective rocker arm (18; 19) mounted for rotation about a respective axis (17) of oscillation; said rocker arm (18; 19) comprising a further arm (24) connected to said second actuating means (30).

3. A device as claimed in claim 2, wherein said rocker arms (18, 19) are located side by side to rotate, in opposite directions about the relative said axes (17) of oscillation, between said open and closed positions; said second actuating means (30) acting in opposite directions on the respective said further arms (24).

4. A device as claimed in claim 3, wherein said rocker arms (18, 19) are connected to each other to rotate in opposite directions with the same law of motion; one of said rocker arms (18; 19) being a control rocker arm (19) cooperating with said locking means (31).

5. A device as claimed in claim 4, wherein said control rocker arm (19) is fitted with a tappet (22); said locking means (31) comprising a guide plate (35) for said tappet (22); said guide plate (35) being movable between an engaged position engaging said tappet (22) and a detached position detached from said tappet (22), and maintaining said rocker arms (18; 19) in said closed position when in said engaged position.

6. A device as claimed in claim 1, wherein said elastic actuating means (30) comprises springs.

7. A device for end closing tubular wrappings (2) of products (3), the device comprising:

a scissor-type parting device (8), in turn comprising two arms (23) movable with respect to each other between a closed rest position and an open stretch position;

first actuating means (10, 12) for imparting to said parting device (8) an insertion stroke and an opposite extraction stroke in a first given direction (11) with respect to an end portion (6) of the tubular wrapping (2) projecting from a corresponding end (7) of the relative product (3);

second actuating means (30) for moving said arms (23) from said closed position to said open position, to deform said end portion (6) into a duckbill shape and define, on the deformed end portion (6), two facing, substantially flat walls (41) and for enabling said arms (23) to exert substantially constant pressure on said end portion (6) of the tubular wrapping (2) throughout the extraction stroke;

two folding-sealing members (38) movable in opposite senses in a second direction (39) crosswise to said first direction (11) to seal said walls (41) to each other; and locking means (31) for keeping said arms (23) in the closed rest position during the insertion stroke;

wherein each said arm (23) forms part of a respective rocker arm (18; 19) mounted for rotation about a respective axis (17) of oscillation; said rocker arm (18; 19) comprising a further arm (24) connected to said second actuating means (30).

8. A device as claimed in claim 7, wherein said rocker arms (18, 19) are located side by side to rotate, in opposite directions about the relative said axes (17) of oscillation, between said open and closed positions; said second actuating means (30) acting in opposite directions on the respective said further arms (24).

9. A device as claimed in claim 8, wherein said rocker arms (18, 19) are connected to each other to rotate in opposite directions with the same law of motion; one of said rocker arms (18; 19) being a control rocker arm (19) cooperating with said locking means (31).

10. A device as claimed in claim 9, wherein said control rocker arm (19) is fitted with a tappet (22); said locking means (31) comprising a guide plate (35) for said tappet (22); said guide plate (35) being movable between an engaged position engaging said tappet (22) and a detached position detached from said tappet (22), and maintaining said rocker arms (18; 19) in said closed position when in said engaged position.

* * * * *